US009272869B2

(12) United States Patent
Takitani et al.

(10) Patent No.: US 9,272,869 B2
(45) Date of Patent: Mar. 1, 2016

(54) PAPER SHEET PROCESSING APPARATUS

(71) Applicant: Duplo Seiko Corporation, Kinokawa-shi (JP)

(72) Inventors: Kazuya Takitani, Kinokawa (JP); Satomi Uegaito, Kinokawa (JP)

(73) Assignee: DUPLO SEIKO CORPORATION, Kinokawa-Shi, Wakayama (JP)

( * ) Notice: Subject to any disclaimer, the term of this patent is extended or adjusted under 35 U.S.C. 154(b) by 0 days.

(21) Appl. No.: 14/471,399

(22) Filed: Aug. 28, 2014

(65) Prior Publication Data

US 2015/0061218 A1 Mar. 5, 2015

(30) Foreign Application Priority Data

Aug. 30, 2013 (JP) ..... 2013-179744

(51) Int. Cl.
*B65H 7/20* (2006.01)
*B65H 35/02* (2006.01)
*B65H 35/04* (2006.01)

(52) U.S. Cl.
CPC ..... *B65H 7/20* (2013.01); *B65H 35/02* (2013.01); *B65H 35/04* (2013.01); *B65H 2551/10* (2013.01); *B65H 2551/20* (2013.01)

(58) Field of Classification Search
CPC ..... B65H 5/00; B65H 39/00; B65H 37/00; B65H 2551/00; B65H 2551/10; B65H 2551/20; B65H 2551/21; B65H 7/20; B65H 35/02; B65H 35/04
See application file for complete search history.

(56) References Cited

U.S. PATENT DOCUMENTS

| | | | | |
|---|---|---|---|---|
| 5,313,253 | A * | 5/1994 | Martin et al. | 399/16 |
| 5,644,494 | A * | 7/1997 | Richardson et al. | 700/223 |
| 2003/0035143 | A1 | 2/2003 | Glemser et al. | |
| 2003/0036468 | A1 | 2/2003 | Blank et al. | |
| 2009/0065997 | A1 * | 3/2009 | Yamaguchi | 270/1.01 |
| 2010/0025926 | A1 * | 2/2010 | Shimizu | 271/225 |
| 2010/0066005 | A1 * | 3/2010 | Ueda | 271/3.17 |

(Continued)

FOREIGN PATENT DOCUMENTS

| | | |
|---|---|---|
| JP | 2003-182927 A | 7/2003 |
| JP | 2005-239308 A | 9/2005 |

OTHER PUBLICATIONS

Extended European Search Report dated Feb. 17, 2015, issued by the European Patent Office in the corresponding European Application No. 14182399.7. (6 pages).

*Primary Examiner* — David H Bollinger
(74) *Attorney, Agent, or Firm* — Buchanan Ingersoll & Rooney PC

(57) ABSTRACT

A paper sheet processing apparatus 1 for performing processes on paper sheets while conveying the paper sheets, being equipped with an apparatus body 10, processing means 3 for performing predetermined processes on the paper sheets, a control section 5 for controlling the operation of the paper sheet processing apparatus 1, an input section 6 to which a paper sheet processing condition is input, and a display section 7 for displaying the operation information of the paper sheet processing apparatus 1, wherein the processing means 3 is configured so that the processing pattern for the paper sheets can be changed, and the control section 5 obtains processing means setting information, serving as the processing pattern of the processing means 3, for achieving the processing condition having been input to the input section 6 and displays the processing means setting information on the display section 7.

11 Claims, 7 Drawing Sheets

(56) References Cited

U.S. PATENT DOCUMENTS

2010/0289207 A1* 11/2010 Mano ..... 271/3.14
2011/0211888 A1* 9/2011 Fujinaga ..... 399/403
2011/0233852 A1* 9/2011 Ikarashi ..... 271/207
2012/0286465 A1* 11/2012 Ooba ..... 271/9.01
2013/0056922 A1* 3/2013 Tsujita ..... 271/9.05

* cited by examiner

PAPER SHEET PROCESSING APPARATUS

TECHNICAL FIELD

The present invention relates to a paper sheet processing apparatus equipped with processing means for performing processes, such as cutting and crease forming in paper sheets.

BACKGROUND ART

The paper sheet processing apparatus disclosed in Patent Document 1 is equipped, as processing means, with a cutting device section having a slitter processing unit; an optional processing device section in which one of plural kinds of processing units (such as a perforation forming unit and a crease forming unit) can be mounted; a lateral cutting device section having a cutter processing unit; and a lateral crease forming device section having a crease forming unit, and a processing unit to be mounted in the optional processing device section is selected according to the processing condition for paper sheets. Furthermore, the paper sheet processing apparatus disclosed in Patent Document 2 has a plurality of accommodating spaces in which processing modules can be mounted, and a processing module selected from among plural kinds of processing modules is mounted according to the processing condition for paper sheets.

CITATION LIST

Patent Literature

Patent Document 1: JP 2005-239308 A
Patent Document 2: JP 2003-182927 A

SUMMARY OF INVENTION

Technical Problem

In the paper sheet processing apparatus according to Patent Document 1, although a processing unit to be mounted in the optional processing device section can be selected, the order of processing is fixed; hence, in the case that plural kinds of processes are applied to paper sheets, the processes are not performed according to the order of processing suited for the processing condition for the paper sheets. Moreover, in Patent Document 2, in the case that the processing modules are respectively mounted in the accommodating spaces, there is a problem that the user is required to determine the accommodating spaces in which the respective processing modules are accommodated on the basis of the processing condition for paper sheets in consideration of the order of processing optimal for the processing condition.

Accordingly, the present invention provides a paper sheet processing apparatus configured so as to display processing means setting information in consideration of the contents of processing and the order of processing, that is, a processing pattern, on the basis of the processing condition for paper sheets.

Solution to Problem

A first aspect of the present application is a paper sheet processing apparatus for performing processes on paper sheets while conveying the paper sheets, being equipped with an apparatus body, processing means for performing predetermined processes on the paper sheets, a control section for controlling the operation of the paper sheet processing apparatus, an input section to which a paper sheet processing condition is input, and a display section for displaying the operation information of the paper sheet processing apparatus, wherein the processing means is configured so that the processing pattern for the paper sheets can be changed, and the control section obtains processing means setting information, serving as the processing pattern of the processing means, for achieving the processing condition having been input to the input section and displays the processing means setting information on the display section.

With the above-mentioned configuration, since the control section obtains processing means setting information for achieving the processing condition having been input to the input section and displays the processing means setting information on the display section, the user sets the processing means in the paper sheet processing apparatus on the basis of the displayed processing means setting information, whereby processing can be performed correctly under the predetermined processing condition according to an optimum processing pattern.

The above-mentioned first aspect is preferably further equipped with the following configurations.

(1) The paper sheet processing apparatus is equipped with a storage section for storing user-owned information serving as the processing pattern of the processing means owned by the user and included in the processing means, wherein the control section obtains processing means setting information preferentially including the processing pattern included in the user-owned information and displays the processing means setting information on the display section.

(2) In a different setting state in which the processing means according to a processing pattern different from that indicated in the processing means setting information has been set, the control section judges whether the processing condition having been input to the input section can be achieved, and the control section performs control to carry out processing upon judging that the processing condition can be achieved and stops the processing upon judging that the processing condition cannot be achieved.

(3) In the above-mentioned configuration (2), in the case that the control section judges that the processing condition having been input to the input section can be achieved in the different setting state and performs control to carry out processing, the control section adjusts paper sheet conveying speed so that a processing result similar to that based on the processing means setting information can be obtained.

(4) The processing means includes plural kinds of processing units being different in the kinds of processes, the paper sheet processing apparatus is further equipped with one or more unit receiving sections, provided in the apparatus body, for detachably receiving the respective processing units, the paper sheet processing apparatus is equipped, as the processing units, with a cutting unit for cutting a paper sheet and at least one processing unit selected from among a perforation forming unit for forming a perforation in a paper sheet, a crease forming unit for forming a crease in a paper sheet, a cutting unit for cutting a paper sheet and a conveying unit for assisting the conveyance of a paper sheet, and in the case that paper sheet cutting is included in the processing condition having been input to the input section, the control section obtains, as processing means setting information, processing unit receiving information indicating the kinds of processes of the processing units to be received in the respective unit receiving sections so that the cutting unit is placed on the downstream side of the paper sheet processing from the other processing units, and the control section displays the processing unit receiving information on the display section.

(5) In the above-mentioned configuration (4), the processing unit receiving information includes the information on the processing blades provided in the processing units.

With the above-mentioned configuration (1), since the control section obtains processing means setting information preferentially including the processing pattern of the processing means owned by the user and displays the processing means setting information on the display section, the processing pattern of the processing means owned by the user can be used effectively.

With the above-mentioned configuration (2), even in a different setting state in which the processing means according to a processing pattern different from that indicated in the processing means setting information has been set, processing can be performed in the case that the processing condition having been input to the input section can be achieved; however, processing can be stopped in the case that the processing condition having been input to the input section cannot be achieved.

With the above-mentioned configuration (3), even in the case that processing is performed in such a different setting state, a processing result similar to that obtained on the basis of the processing means setting information can be obtained.

The above-mentioned configuration (4) is a specific configuration for changing the processing pattern of the processing means, wherein the processing pattern can be changed by causing the unit receiving sections to respectively receive plural kinds of processing units being different in the kinds of processes. Furthermore, as processing means setting information, the cutting unit is placed on the downstream side of the paper sheet processing from the other processing units so that the processing can be performed optimally. This setting is done in consideration of the fact that when a paper sheet is cut, the overall shape of the paper sheet is changed; hence, the other processes are performed before the overall shape is changed, whereby paper sheet processing can be performed smoothly.

The above-mentioned configuration (5) is a specific configuration of the processing unit receiving information, wherein since the processing unit receiving information includes the information on the processing blades mounted in the processing units, even in the case that a processing unit has a plurality of processing blades, the processing blades can be displayed distinctively.

A second aspect of the present application is a paper sheet processing apparatus for performing processes on paper sheets while conveying the paper sheets, being equipped with an apparatus body, processing means for performing predetermined processes on the paper sheets, a control section for controlling the operation of the paper sheet processing apparatus, an input section to which a paper sheet processing condition is input, a display section for displaying the operation information of the paper sheet processing apparatus, and a storage section for storing user-owned information serving as the processing pattern of the processing means owned by the user and included in the processing means, wherein the processing means is configured so that the processing pattern for the paper sheets can be changed, and the control section performs control so that a processing condition under which processing cannot be performed according to the processing pattern of the processing means included in the user-owned information stored in the storage section cannot be input to the input section. The user-owned information serving as the processing pattern of the processing means owned by the user may be the processing pattern of the entire processing means owned by the user or may be the processing pattern of the processing means mounted in the paper sheet processing apparatus.

With the above-mentioned configuration, since the control section performs control so that a processing condition under which processing cannot be performed according to the processing pattern of the processing means included in the user-owned information stored in the storage section cannot be input to the input section, the user is prevented from making a mistake of inputting the processing pattern of the processing means not owned by himself into the input section.

The second aspect preferably has the following configuration.

(1) The control section displays, on the display section, the processing conditions under which processing can be performed according to the processing pattern of the processing means included in the user-owned information, and the input of the paper sheet processing condition to the input section is performed by selection from among the processing conditions displayed on the display section.

The above-mentioned configuration (1) is a specific configuration in which the control section performs control so that a processing condition under which processing cannot be performed according to the processing pattern of the processing means included in the user-owned information stored in the storage section cannot be input to the input section; with this configuration, the user is easily prevented from making a mistake of inputting the processing pattern of the processing means not owned by himself into the input section.

Advantageous Effects of Invention

In conclusion, since the present invention can provide a paper sheet processing apparatus configured so as to display processing means setting information in consideration of a processing pattern on the basis of the processing condition for paper sheets, even if the user is unfamiliar with the handling of the paper sheet processing apparatus, the user can perform processing correctly under the predetermined processing condition according to an optimum processing pattern by setting processing means on the basis of the displayed processing means setting information.

DESCRIPTION OF EMBODIMENTS (Overall Configuration)

Figure 1:
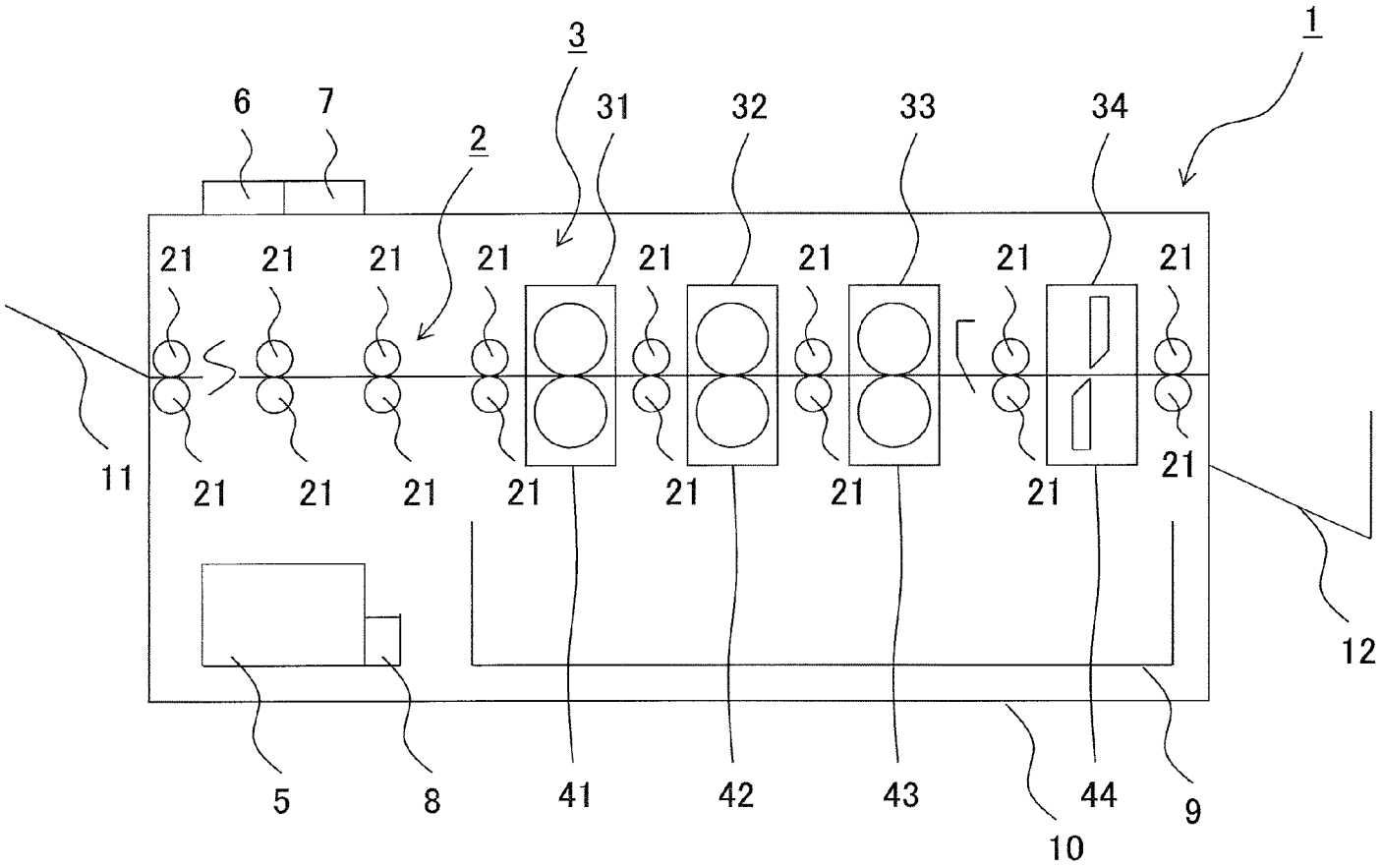
FIG. 1 is a schematic cross-sectional view showing the overall configuration of a paper sheet processing apparatus according to an embodiment of the present invention.

FIG. 1 is a schematic cross-sectional view showing the overall configuration of a paper sheet processing apparatus according to an embodiment of the present invention. A paper sheet processing apparatus 1 is equipped with a paper sheet feeding section 11 and a paper sheet discharging section 12 at both ends of an apparatus body 10. From the paper sheet feeding section 11 to the paper sheet discharging section 12, a conveying route 20 is formed of conveying means 2 composed of multiple pairs of rollers 21. To the conveying means 2, conveyance driving means (not shown) is connected. In addition, on the conveying route 20, processing means 3 for performing predetermined processes on paper sheets is provided. The processing means 3 includes plural kinds of processing units being different in the kinds of processes and is equipped, as the processing units, with a perforation forming unit 31 for forming a perforation in a paper sheet in the paper sheet conveying direction (in the longitudinal direction), a crease forming unit 32 for forming a crease in a paper sheet in the paper sheet conveying direction, a cutting unit (slitter unit) 33 for cutting a paper sheet in the paper sheet conveying direction, and a cutting unit (cutter unit) 34 for cutting a paper sheet in the direction (lateral direction) orthogonal to the paper sheet conveying direction. However, the processing units are not limited to those described above, but include, for example, a half-cut forming unit for forming a half-cut in a paper sheet in the paper sheet conveying direction, a lateral half-cut forming unit for forming a half-cut in a paper sheet in the direction orthogonal to the paper sheet conveying direction, a lateral perforation forming unit for forming a perforation in a paper sheet in the direction orthogonal to the paper sheet conveying direction, and a lateral crease forming unit for forming a crease in a paper sheet in the direction orthogonal to the paper sheet conveying direction. Furthermore, the processing units also include a conveying unit for conveying paper sheets, without performing processing on the paper sheets.

The paper sheet processing apparatus 1 is provided in the apparatus body 10 and is equipped with one or more unit receiving sections 41, 42, 43 and 44 for detachably receiving the respective processing units. Although the number of the unit receiving sections is four in this embodiment, the number of the unit receiving sections is not limited to four, but may be one or more. When received in the unit receiving sections, the processing units are connected to processing driving means (not shown).

In addition, inside the apparatus body 10, the paper sheet processing apparatus 1 is equipped with a control section 5 for controlling the operation of the entire apparatus. Furthermore, on the surface of the apparatus body 10, the paper sheet processing apparatus 1 is equipped with an input section 6 to which a paper sheet processing condition is input, and a display section 7 for displaying the operation information of the paper sheet processing apparatus 1. The display section 7 may display the operation information on a liquid crystal screen or may display the operation information, for example, by turning on and off LED lamps or the like or by changing the lighting colors thereof. Inside the apparatus body 10, the paper sheet processing apparatus 1 is equipped with a storage section 8 for storing user-owned information on the kinds of processes of the processing means 3 owned by the user. What's more, on the bottom section inside the apparatus body 10, the paper sheet processing apparatus 1 is equipped with a waste box 9 for accommodating chips generated by paper sheet cutting processing.

The paper sheet processing apparatus 1 operates as described below.

First, from a bundle of paper sheets loaded on the paper sheet feeding section 11, the paper sheets are fed one by one to the conveying route 20. Each paper sheet is then conveyed along the conveying route 20 by the rollers 21 and enters the perforation forming unit 31 received in the unit receiving section 41. The perforation forming unit 31 is controlled by the control section 5 and forms a perforation in the paper sheet in the longitudinal direction.

Next, the paper sheet in which the perforation has been formed by the perforation forming unit 31 is conveyed along the conveying route 20 by the rollers 21 and enters the crease forming unit 32 received in the unit receiving section 42. The crease forming unit 32 is controlled by the control section 5 and forms a crease in the paper sheet in the longitudinal direction.

The paper sheet in which the crease has been formed by the crease forming unit 32 is conveyed along the conveying route 20 by the rollers 21 and enters the slitter unit 33 received in the unit receiving section 43. The slitter unit 33 is controlled by the control section 5 and cuts the paper sheet in the longitudinal direction. The unnecessary portions of the paper sheet having been cut are dropped into the waste box 9.

The paper sheet having been cut in the longitudinal direction by the slitter unit 33 is conveyed along the conveying route 20 by the rollers 21 and enters the cutter unit 34 received in the unit receiving section 44. The cutter unit 34 is controlled by the control section 5 and cuts the paper sheet in the lateral direction. The unnecessary portions of the paper sheet having been cut are dropped into the waste box 9.

The paper sheet having been cut in the lateral direction by the cutter unit 34 is conveyed along the conveying route 20 by the rollers 21 and discharged to the paper sheet discharging section 12. The paper sheet, in which the perforation and the crease have been formed and which has been cut in the longitudinal direction and the lateral direction, is stacked on the paper sheet discharging section 12.

CONTROL EXAMPLE 1 OF THE CONTROL SECTION

Figure 2:
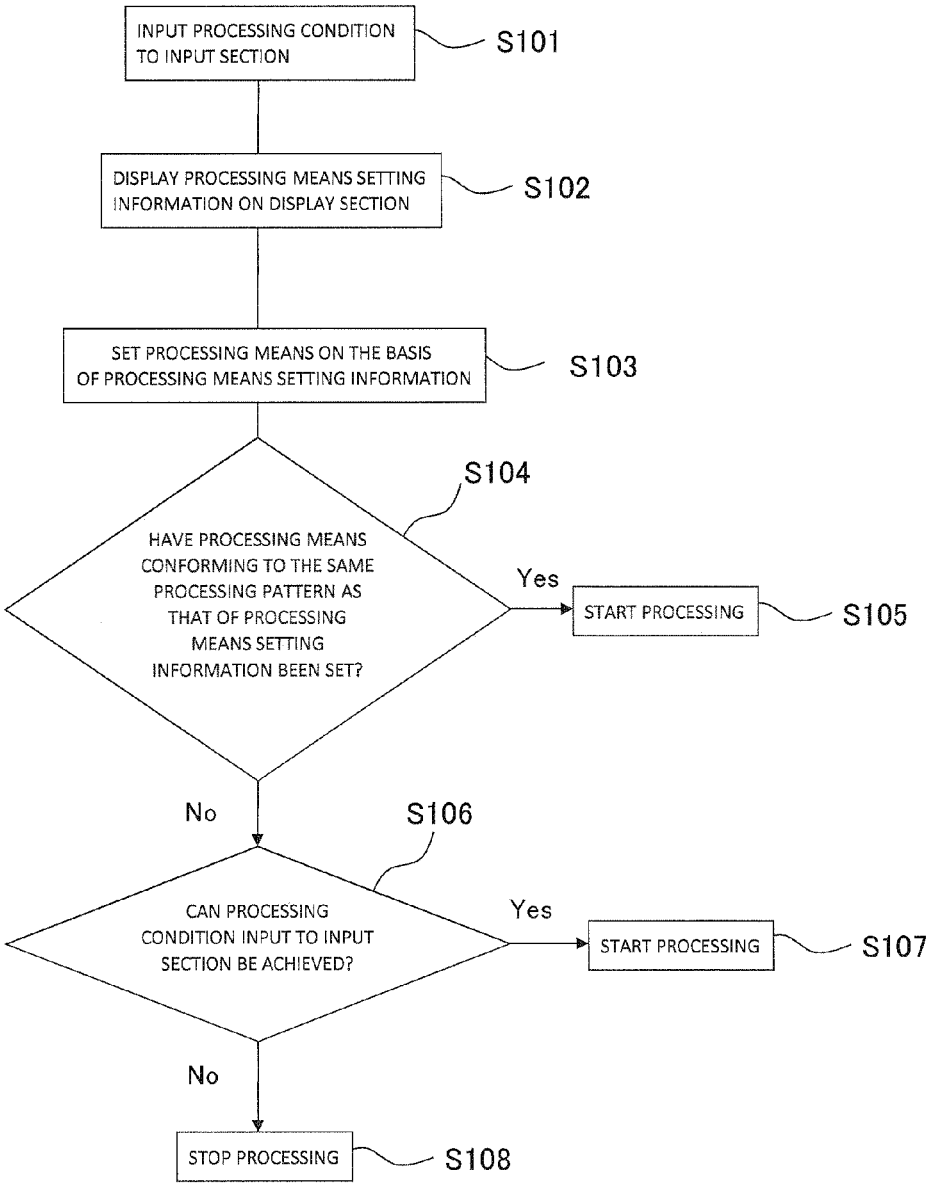
FIG. 2 is a flow chart showing a control example of a control section.

FIG. 2 is a flow chart showing a control example of the control section 5. The control contents of the control section 5 will be described below on the basis of FIG. 2.

In the case of performing predetermined processes on a paper sheet, the user inputs the processing condition corresponding thereto to the input section 6 (at step (hereafter denoted as S) 101). For example, in the case that the user desires that a perforation is formed in the longitudinal direction at a predetermined position of the paper sheet, that a crease is formed in the longitudinal direction at a predetermined position of the paper sheet, that cutting is performed in the longitudinal direction at a predetermined position of the paper sheet, and that cutting is performed in the lateral direction at a predetermined position of the paper sheet, the user inputs the above-mentioned processing condition (hereafter referred to as "processing condition 1") to the input section 6.

In order that the processing condition 1 input to the input section 6 is achieved, the control section 5 displays, on the display section 7, processing means setting information (hereafter referred to as "processing means setting information 1") indicating that the perforation forming unit (rotary blade) 31 is mounted in the receiving section 41, the crease forming unit (rotary blade) 32 is mounted in the receiving section 42, the slitter unit (rotary blade) 33 is mounted in the receiving section 43, and the cutter unit (guillotine blade) 34 is mounted in the receiving section 44 (at S102). At this time, in this embodiment, the processing means setting information 1 corresponds to processing unit receiving information on the kinds of processes performed by the processing units to be received respectively in the unit receiving sections 41, 42, 43 and 44, and as the processing means setting information 1, not only the names of the processing units but also the kinds of blades to be mounted in the processing units, as indicated in parentheses, are displayed.

At this time, in order to derive the processing means setting information 1, in consideration of the respective processes of the processing condition 1, in the case that the process of cutting (longitudinal cutting and lateral cutting) is included in the processing condition, the control section 5 places the cutting process on the downstream side of the processing from the other processes, such as the perforation forming process and the crease forming process. In other words, the control section 5 places the slitter unit 33 and the cutter unit 34 on the downstream side of the processing from the other processing units, such as the perforation forming unit 31 and the crease forming unit 32.

On the basis of the processing means setting information 1 displayed on the display section 7, the user mounts the units 31, 32, 33 and 34 in the receiving sections 41, 42, 43 and 44, respectively (at S103). The control section 5 then judges whether the processing means conforming to the same processing pattern as that of the processing means setting information 1 has been set (at S104).

At this time, in the case that the user mounts the perforation forming unit (rotary blade) 31 in the receiving section 41, mounts the crease forming unit (rotary blade) 32 in the receiving section 42, mounts the slitter unit (rotary blade 33 in the receiving section 43, and mounts the cutter unit (guillotine blade) 34 in the receiving section 44, the control section 5 judges that the processing means conforming to the same processing pattern as that of the processing means setting information 1 has been set, and the control section 5 starts the processing in the paper sheet processing apparatus 1 (at S105). As a result, a paper sheet having been subjected to the processing conforming to the processing condition 1 can be obtained by the paper sheet processing apparatus 1.

Furthermore, in the case that the user mounts the perforation forming unit (rotary blade) 31 in the receiving section 41, mounts the crease forming unit (rotary blade) 32 in the receiving section 42, mounts the slitter unit (rotary blade) 33 in the receiving section 43, and mounts the cutter unit (rotary blade) in the receiving section 44, since the processing unit mounted in the receiving section 44 is the cutter unit (rotary blade), the state of the setting is a different setting state being different from the setting indicated in the cutting means setting information 1 in which the cutter unit (guillotine blade) is indicated. The control section 5 judges that the state of the setting is a different setting state in which the processing means for the kinds of processes being different from those indicated in the processing means setting information 1 has been set.

In this case, the control section 5 judges whether the processing condition 1 having been input to the input section 6 can be achieved (at S106). The control section 5 then judges that the cutter unit (rotary blade) can cut the paper sheet at a predetermined position thereof in the lateral direction, and the control section 5 starts the processing in the paper sheet processing apparatus 1 (at S107). At this time, the control section 5 controls the conveying means 2 and adjusts the paper sheet conveying speed thereof so that a processing result similar to that obtained using the cutter unit (guillotine blade) can be obtained using the cutter unit (rotary blade).

On the other hand, in the case that the user mounts the perforation forming unit (rotary blade) 31 in the receiving section 41, mounts the crease forming unit (rotary blade) 32 in the receiving section 42, mounts the slitter unit (rotary blade) 33 in the receiving section 43, and mounts the lateral perforation forming unit (guillotine blade) in the receiving section 44, since the processing unit mounted in the receiving section 44 is the lateral perforation forming unit (guillotine blade), the state of the setting is a different setting state being different from the setting indicated in the cutting means setting information 1 in which the cutter unit (guillotine blade) is indicated. The control section 5 judges that the state of the setting is a different setting state in which the processing means for the kinds of processes being different from those indicated in the processing means setting information 1 has been set.

In this case, the control section 5 judges whether the processing condition 1 having been input to the input section 6 can be achieved (at S106). The control section 5 then judges that the lateral perforation forming unit (guillotine blade) cannot cut the paper sheet at a predetermined position thereof in the lateral direction, and the control section 5 performs control so as to stop the processing in the paper sheet processing apparatus 1 (at 5108).

It is assumed that such a different setting state occurs not only in the case that a processing unit different from the processing unit indicated in the processing means setting information 1 has been set as described above, but also, for example, in the above-mentioned case, in the case that the user mounts the perforation forming unit (rotary blade) in the receiving section 41, mounts the slitter unit (rotary blade) in the receiving section 42, mounts the crease forming unit (rotary blade) in the receiving section 43, and mounts the cutter unit (guillotine blade) in the receiving section 44, in other words, in the case that the mounting positions of the crease forming unit (rotary blade) and the slitter unit (rotary blade) are reversed between the receiving section 42 and the receiving section 43. In this latter case, the control section 5 judges whether the processing condition 1 having been input to the input section 6 can be achieved (at S106). The control section 5 then judges that the processing condition 1 can be achieved even if the order of the crease forming unit (rotary blade) and the slitter unit (rotary blade) is reversed, and the control section 5 starts the processing in the paper sheet processing apparatus 1 (at S107). At this time, since the slitter unit (rotary blade) is mounted on the upstream side from the crease forming unit (rotary blade), the control section 5 controls the conveying means 2 and adjusts the paper sheet conveying speed thereof so that a processing result similar to that obtained in the case that the slitter unit (rotary blade) is mounted on the downstream side from the crease forming unit (rotary blade). In particular, in the case that the slitter unit is mounted on the upstream side from the crease forming unit or the perforation forming unit as described above, a processing result similar to that obtained in the case that the setting has been done as indicated in the processing condition 1 can be obtained by adjusting the paper sheet conveying speed to low.

CONTROL EXAMPLE 2 OF THE CONTROL SECTION

Figure 3:
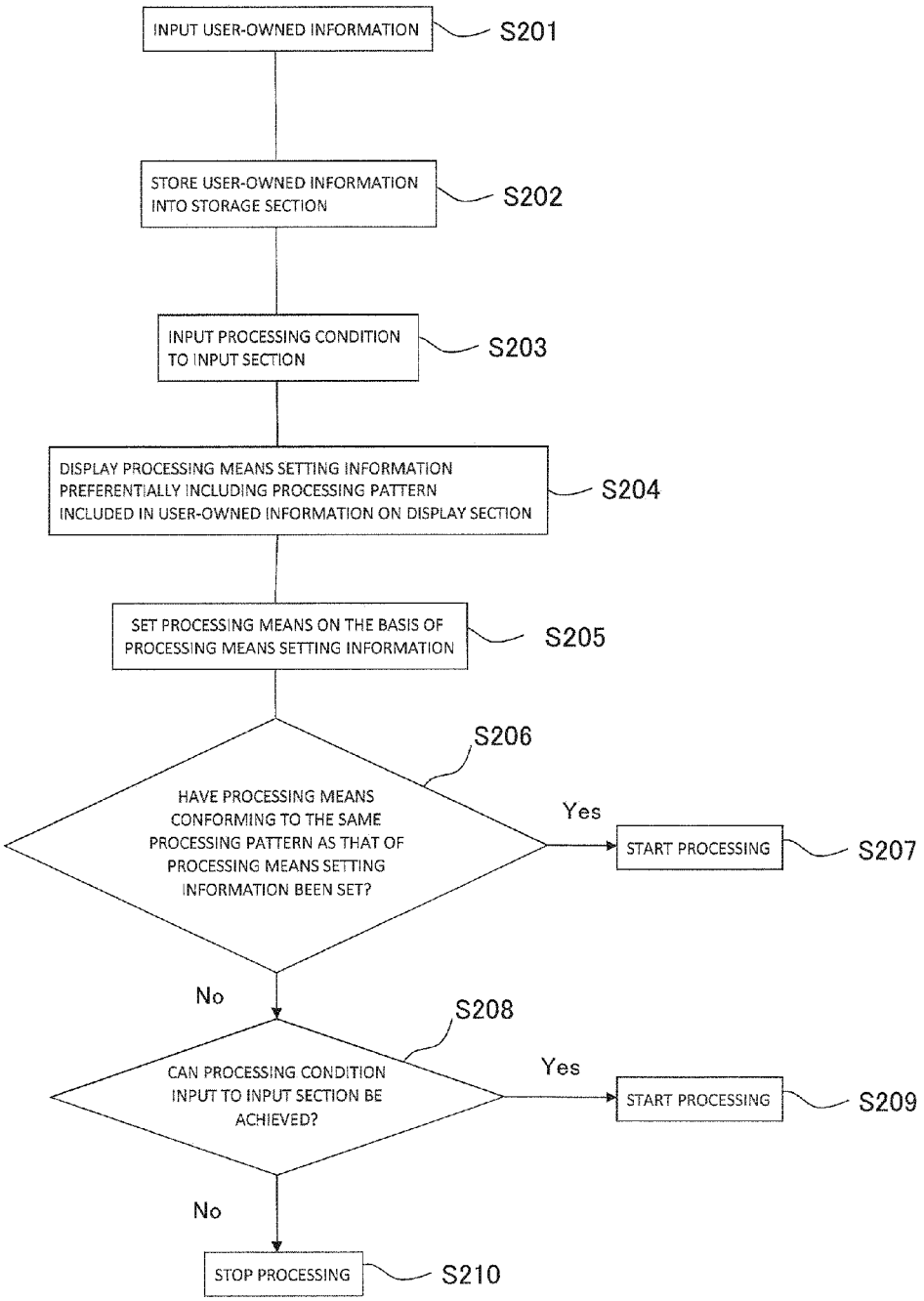
FIG. 3 is a flow chart showing a control example of the control section in the case that user-owned information on the kinds of processes of the processing means owned by the user has been stored in a storage section.

FIG. 3 is a flow chart showing a control example of the control section 5 in the case that the user-owned information on the kinds of processes of the processing means 3 owned by the user has been stored in the storage section 8. The control contents of the control section 5 will be described below on the basis of FIG. 3.

The user can store the user-owned information on the kinds of processes of the processing means owned by himself in the storage section 8 of the paper sheet processing apparatus 1. In this case, the user inputs the kinds of processes of the processing means owned by himself to the input section 6 (at S201). For example, in the case that the user owns the perforation forming unit (rotary blade), the crease forming unit (rotary blade), the slitter unit (rotary blade), the cutter unit (rotary blade) and the lateral perforation forming unit (guillotine blade), the user inputs the information (hereafter referred to as "user-owned information 2"). At this time, the user-owned information 2 includes not only the names of the processing units but also the kinds of blades to be mounted in the processing units, as indicated in parentheses. The control section 5 stores the user-owned information 2 having been input to the input section 6 into the storage section 8 (at S202).

In the case of performing predetermined processes on a paper sheet, the user inputs the processing condition corresponding thereto to the input section 6 (at S203). For example, in the case that the user desires that a perforation is formed in the longitudinal direction at a predetermined position of the paper sheet, that a crease is formed in the longitudinal direction at a predetermined position of the paper sheet, that cutting is performed in the longitudinal direction at a predetermined position of the paper sheet, and that cutting is performed in the lateral direction at a predetermined position of the paper sheet, the user inputs the above-mentioned processing condition (hereafter referred to as "processing condition 2") to the input section 6.

In the case that the user-owned information 2 has been stored in the storage section 8, the control section 5 obtains processing means setting information (hereafter referred to as "processing means setting information 2") preferentially including the processing means included in the user-owned information 2 and displays the processing means setting information 2 on the display section 7 (at S204). At this time, the processing means setting information 2 includes the information indicating that "the perforation forming unit (rotary blade) 31 is mounted in the receiving section 41, the crease forming unit (rotary blade) 32 is mounted in the receiving section 42, the slitter unit (rotary blade) 33 is mounted in the receiving section 43, and the cutter unit (rotary blade) 34 is mounted in the receiving section 44." In the case that the paper sheet is cut at a predetermined position in the lateral direction, it is essentially preferable that the cutter unit (guillotine blade) is mounted in the receiving section 44 from the viewpoint of reducing processing time; however, the control section 5 recognizes that the user does not have the cutter unit (guillotine blade) according to the user-owned information 2, and the control section 5 displays, on the display section 7, the setting in which the cutter unit (rotary blade) 34 is mounted in the receiving section 44 so as to preferentially include the processing means included in the user-owned information 2. At this time, in this embodiment, the processing means setting information 2 corresponds to processing unit receiving information on the kinds of processes performed by the processing units to be received respectively in the unit receiving sections 41, 42, 43 and 44, and as the processing means setting information 2, not only the names of the processing units but also the kinds of blades to be mounted in the processing units, as indicated in parentheses, are displayed.

At this time, in order to derive the processing means setting information 2, in consideration of the respective processes of the processing condition 2, in the case that the process of cutting (longitudinal cutting and lateral cutting) is included in the processing condition, the control section 5 places the cutting process on the downstream side of the processing from the other processes, such as the perforation forming process and the crease forming process. In other words, the control section 5 places the slitter unit 33 and the cutter unit 34 on the downstream side of the processing from the other processing units, such as the perforation forming unit 31 and the crease forming unit 32.

On the basis of the processing means setting information 2 displayed on the display section 7, the user mounts the units 31, 32, 33 and 34 in the receiving sections 41, 42, 43 and 44, respectively (at S205). The control section 5 then judges whether the processing means conforming to the same processing pattern as that of the processing means setting information 2 has been set (at S206).

At this time, in the case that the user mounts the perforation forming unit (rotary blade) 31 in the receiving section 41, mounts the crease forming unit (rotary blade) 32 in the receiving section 42, mounts the slitter unit (rotary blade) 33 in the receiving section 43, and mounts the cutter unit (rotary blade) in the receiving section 44, the control section 5 judges that the processing means conforming to the same processing pattern as that of the processing means setting information 2 has been set, and the control section 5 starts the processing in the paper sheet processing apparatus 1 (at S207). As a result, a paper sheet having been subjected to the processing conforming to the processing condition 2 can be obtained by the paper sheet processing apparatus 1.

Furthermore, in the case that the user mounts the perforation forming unit (rotary blade) 31 in the receiving section 41, mounts the slitter unit (rotary blade) in the receiving section 42, mounts the crease forming unit (rotary blade) in the receiving section 43, and mounts the cutter unit (rotary blade) 34 in the receiving section 44, in other words, in the case that the mounting positions of the crease forming unit (rotary blade) and the slitter unit (rotary blade) are reversed between the receiving section 42 and the receiving section 43, the control section 5 judges that the state of the setting is a different setting state in which the processing means for the kinds of processes being different from those indicated in the processing means setting information 2 has been set.

In this case, the control section 5 judges whether the processing condition 2 having been input to the input section 6 can be achieved (at S208). The control section 5 then judges that the processing condition 2 can be achieved even if the order of the crease forming unit (rotary blade) and the slitter unit (rotary blade) is reversed, and the control section 5 starts the processing in the paper sheet processing apparatus 1 (at S209). At this time, since the slitter unit (rotary blade) is mounted on the upstream side from the crease forming unit (rotary blade), the control section 5 controls the conveying means 2 and adjusts the paper sheet conveying speed thereof so that a processing result similar to that obtained in the case that the slitter unit (rotary blade) is mounted on the downstream side from the crease forming unit (rotary blade). In particular, in the case that the slitter unit is mounted on the upstream side from the crease forming unit or the perforation forming unit as described above, a processing result similar to that obtained in the case that the setting has been done as indicated in the processing means setting information 2 can be obtained by adjusting the paper sheet conveying speed to low.

Furthermore, in the case that the user mounts the perforation forming unit (rotary blade) 31 in the receiving section 41, mounts the crease forming unit (rotary blade) 32 in the receiving section 42, mounts the slitter unit (rotary blade) 33 in the receiving section 43, and mounts the lateral perforation forming unit (guillotine blade) in the receiving section 44, since the processing unit mounted in the receiving section 44 is the lateral perforation forming unit (guillotine blade), the state of the setting is a different setting state being different from the setting indicated in the processing means setting information 2 in which the cutter unit (guillotine blade) is indicated. The control section 5 judges that the state of the setting is a different setting state in which the processing means for the kinds of processes being different from those indicated in the processing means setting information 2 has been set.

In this case, the control section 5 judges whether the processing condition 2 having been input to the input section 6 can be achieved (at 3208). The control section 5 then judges that the lateral perforation forming unit (guillotine blade) cannot cut the paper sheet at a predetermined positions thereof in the lateral direction, and the control section 5 performs control so as to stop the processing in the paper sheet processing apparatus 1 (at S210).

CONTROL EXAMPLE 3 OF THE CONTROL SECTION

Furthermore, the control section 5 may perform control so that a processing condition under which processing cannot be performed using the kinds of processes of the processing means included in the user-owned information stored in the storage section cannot be input to the input section 6. A specific example thereof will be described below.

The user can store the user-owned information on the kinds of processes of the processing means owned by himself in the storage section 8 of the paper sheet processing apparatus 1. In this case, the user inputs the kinds of processes of the processing means owned by himself to the input section 6. For example, in the case that the user owns the perforation forming unit (rotary blade), the crease forming unit (rotary blade), the slitter unit (rotary blade) and the cutter unit (rotary blade), the user inputs the information (hereafter referred to as "user-owned information 3"). At this time, the user-owned information 3 includes not only the names of the processing units but also the kinds of blades to be mounted in the processing units, as indicated in parentheses. The control section 5 stores the user-owned information 3 having been input to the input section 6 into the storage section 8.

At this time, in the case of performing predetermined processes on a paper sheet, the user inputs the processing condition corresponding thereto to the input section 6. For example, in the case that the user desires that a perforation is formed in the longitudinal direction at a predetermined position of the paper sheet, that a crease is formed in the longitudinal direction at a predetermined position of the paper sheet, that cutting is performed in the longitudinal direction at a predetermined position of the paper sheet, and that half-cutting is performed in the lateral direction at a predetermined position of the paper sheet, the user attempts to input the above-mentioned processing condition (hereafter referred to as "processing condition 3") to the input section 6; however, the control section 5 recognizes that no lateral half-cut forming cutter (rotary blade) is included in the user-owned information 3, and the control section 5 controls the paper sheet processing apparatus 1 so that the user cannot input lateral half-cutting. A specific example of a method in which lateral half-cutting cannot be input includes a method in which although the user attempts to select the respective processes (perforation forming, crease forming, longitudinal cutting and lateral half-cutting) included in the processing condition 3, the control section 5 does not display lateral half-cutting as a choice so that the user cannot input lateral half-cutting.

CONTROL EXAMPLE 4 OF THE CONTROL SECTION

Furthermore, the paper sheet processing apparatus 1 is equipped with detecting means (for example, a sensor), and the control section 5 detects the processing pattern of the processing means mounted in the paper sheet processing apparatus 1 using the detecting means. A specific example of detection using the detecting means is, for example, as described below. That is to say, a through-hole arrangement pattern is formed for the processing unit of the processing means, and the detecting means detects the through-hole arrangement pattern formed for the processing unit, thereby detecting the kind of process of the processing unit and the kind of blade mounted in the processing unit. Besides, as another specific example of detection, the processing unit of the processing means is provided with a light shielding plate and, and on the other hand, the unit receiving section is provided with an optical sensor, and the optical sensor detects the light-shielding property (for example, the presence or absence of light-shielding property) of the light shielding plate, thereby detecting the kind of process of the processing unit and the kind of blade mounted in the processing unit. Moreover, the control section 5 may perform control so that a processing condition under which processing cannot be performed according to the processing pattern of the processing means mounted in the paper sheet processing apparatus 1 cannot be input to the input section 6. A specific example thereof will be described below.

The control section 5 detects the user-owned information on the kinds of processes of the processing means mounted in the paper sheet processing apparatus 1 using the detecting means. For example, in the case that the perforation forming unit (rotary blade), the crease forming unit (rotary blade), the slitter unit (rotary blade) and the cutter unit (rotary blade) are mounted in the paper sheet processing apparatus 1, the detecting means detects the information (hereafter referred to as "user-owned information 4"). At this time, the user-owned information 4 includes not only the names of the processing units but also the kinds of blades to be mounted in the processing units, as indicated in parentheses. The control section 5 stores the detected user-owned information 4 into the storage section 8.

At this time, in the case of performing predetermined processes on a paper sheet, the user inputs the processing condition corresponding thereto to the input section 6. For example, in the case that the user desires that a perforation is formed in the longitudinal direction at a predetermined position of the paper sheet, that a crease is formed in the longitudinal direction at a predetermined position of the paper sheet, that cutting is performed in the longitudinal direction at a predetermined position of the paper sheet, and that half-cutting is performed in the lateral direction at a predetermined position of the paper sheet, the user attempts to input the above-mentioned processing condition (hereafter referred to as "processing condition 4") to the input section 6; however, the control section 5 recognizes that no lateral half-cut forming cutter (rotary blade) is included in the user-owned information 4, and the control section 5 controls the paper sheet processing apparatus 1 so that the user cannot input lateral half-cutting. A specific example of a method in which lateral half-cutting cannot be input includes a method in which although the user attempts to select the respective processes (perforation forming, crease forming, longitudinal cutting and lateral half-cutting) included in the processing condition 4, the control section 5 does not display lateral half-cutting as a choice so that the user cannot input lateral half-cutting.

The paper sheet processing apparatus 1 having the above-mentioned configuration can exhibit the following effects.

(1) Since the control section 5 obtains processing means setting information for achieving the processing condition having been input to the input section 6 and displays the processing means setting information on the display section 7, the user sets the processing means in the paper sheet processing apparatus 1 on the basis of the displayed processing means setting information, whereby processing can be performed correctly under the predetermined processing condition according to an optimum processing pattern.

(2) Since the control section 5 obtains processing means setting information preferentially including the processing pattern of the processing means owned by the user and displays the processing means setting information on the display section 7, the processing pattern of the processing means owned by the user can be used effectively.

(3) Even in a different setting state in which the processing means according to a processing pattern different from that indicated in the processing means setting information has been set, processing can be performed in the case that the processing condition having been input to the input section 6 can be achieved; however, processing can be stopped in the case that the processing condition having been input to the input section 6 cannot be achieved.

(4) Even in the case that processing is performed in such a different setting state, the control section 5 adjusts the paper sheet conveying speed, whereby a processing result similar to that obtained on the basis of the processing means setting information can be obtained.

(5) The processing pattern can be changed by causing the unit receiving sections 41, 42, 43 and 44 to respectively receive plural kinds of processing units being different in the kinds of processes. Furthermore, as processing means setting information, the cutting unit is placed on the downstream side of the paper sheet processing from the other processing units so that the processing can be performed optimally. This setting is done in consideration of the fact that when a paper sheet is cut, the overall shape of the paper sheet is changed; hence, the other processes are performed before the overall shape is changed, whereby processing accuracy can be maintained and the paper sheet processing can be performed smoothly.

(6) Since the processing unit receiving information includes the information on the processing blades mounted in the processing units, even in the case that each processing unit has a plurality of processing blades, the processing blades can be displayed distinctively.

Figure 4:
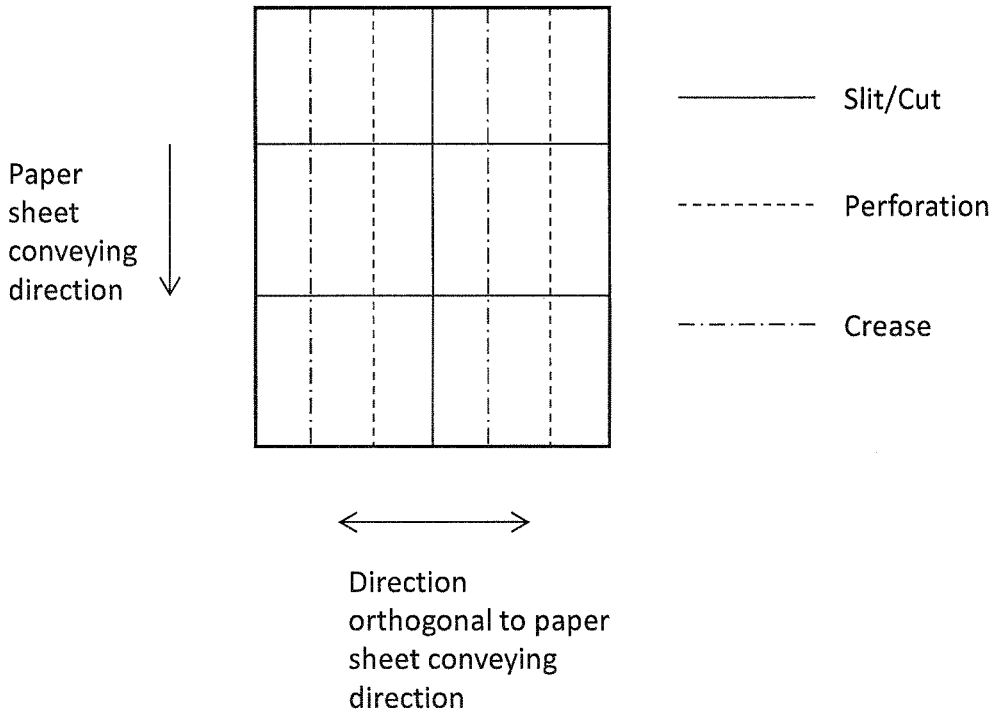
FIG. 4 is a view showing an example of a template displayed on a display section as a condition under which processing can be performed according to the processing pattern of the processing means included in the user-owned information.

(7) Since the control section 5 performs control so that a processing condition under which processing cannot be performed according to the processing pattern of the processing means included in the user-owned information stored in the storage section 8 cannot be input to the input section 6, the user is prevented from making a mistake of the processing pattern of the processing means not owned by himself into the input section 6. As a specific configuration of the control section 5 for performing control so that a processing condition under which processing cannot be performed according to the processing pattern of the processing means included in the user-owned information stored in the storage section 8 cannot be input to the input section 6, a configuration is available in which the control section 5 displays, on the display section 7, the processing conditions under which processing can be performed according to the processing pattern of the processing means included in the user-owned information, and the input of the paper sheet processing condition to the input section 6 is performed by selection from among the processing conditions displayed on the display section 7. The user makes selection from among the processing conditions displayed on the display section 7, thereby inputting the selected processing condition to the input section 6; hence, the user cannot input, to the input section 6, a processing condition under which processing cannot be performed according to the processing pattern of the processing means included in the user-owned information. More specifically, as shown in FIG. 4, a template, obtained by drawing processing lines on a figure showing a paper sheet so that the kinds of processes are distinguished, is displayed on the display section 7 as a processing condition under which processing can be performed according to the processing pattern of the processing means included in the user-owned information, and the user makes selection from among such templates displayed on the display section 7, thereby inputting the processing condition to the input section 6.

In the above-mentioned embodiment, the configuration in which the paper sheet processing pattern using the processing means 3 can be changed has been described such that the change can be made by attaching and detaching the plurality of processing units 31, 32, 33 and 34 being different in the kinds of processes to and from the unit receiving sections 41, 42, 43 and 44; however, the configuration is not limited to that described above, but it may also be possible that the processing pattern is changed, for example, by using the processing means 3 having the following configurations.

Although the input section 6 and the display section 7 are provided on the apparatus body 10 of the paper sheet processing apparatus 1 in the above-mentioned embodiment, the input section and the display section may be provided on a personal computer or other terminal apparatus that is externally connected to the apparatus body 10 by wire or wirelessly.

Although the storage section 8 is provided inside the apparatus body 10 of the paper sheet processing apparatus 1 in the above-mentioned embodiment, the storage section may be provided in a personal computer or other terminal apparatus that is externally connected to the apparatus body 10 by wire or wirelessly.

Although the user-owned information is stored in the storage section 8 in the above-mentioned embodiment, storage means may be a RAM serving as a volatile memory (means in which information stored therein is erased when the power source of the paper sheet processing apparatus 1 is turned off) or an EEPROM serving as a non-volatile memory (means in which information stored therein is not erased even when the power source of the paper sheet processing apparatus 1 is turned off). For example, in the case that the user inputs the user-owned information on the kinds of processes of the processing means owned by the user himself and stores the information in the storage section 8 of the paper sheet processing apparatus 1, it is preferable that the user stores the information in the storage section 8 using the EEPROM. On the other hand, in the case that the control section 5 detects the processing pattern of the processing means mounted in the paper sheet processing apparatus 1 using the detecting means and stores the processing pattern as the user-owned information in the storage section 8, it is preferable that the user-owned information is stored in the storage section 8 using the RAM.

MODIFICATION EXAMPLE 1 OF THE PROCESSING MEANS

Figure 5:
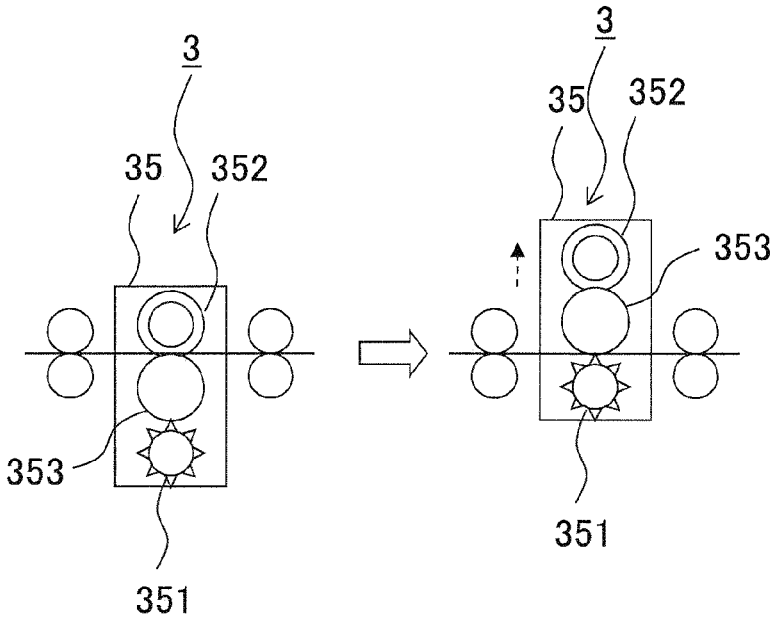
FIG. 5 is a schematic cross-sectional view showing a modification example of the processing means.

FIG. 5 is a schematic cross-sectional view showing a modification example of the processing means 3. As shown in FIG.

5, the processing means 3 includes a processing unit 35, and the processing unit 35 is received in the unit receiving section of the paper sheet processing apparatus 1. The processing unit 35 is equipped with a perforation forming blade 351 on the lower side and a crease forming blade 352 on the upper side and is further equipped, between the perforation forming blade 351 and the crease forming blade 352, with a receiving member 353 opposed to the respective blades 351 and 352. Furthermore, the processing unit 35 is movable in the vertical direction inside the unit receiving section. Moreover, as shown on the left side of FIG. 5, in the case that the processing unit 35 forms a crease in a paper sheet, the processing unit 35 moves downward, and the crease forming blade 352 positioned on the upper side forms a crease in the paper sheet. What's more, as shown on the right side of FIG. 5, in the case that the processing unit 35 forms a perforation in a paper sheet, the processing unit 35 moves upward, and the perforation forming blade 351 positioned on the lower side forms a perforation in the paper sheet.

MODIFICATION EXAMPLE 2 OF THE PROCESSING MEANS

Figure 6:
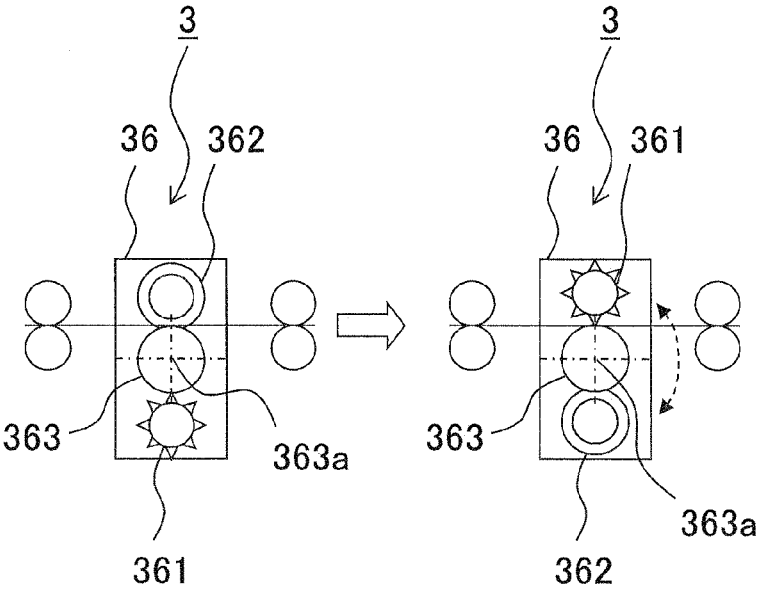
FIG. 6 is a schematic cross-sectional view showing another modification example of the processing means.

FIG. 6 is a schematic cross-sectional view showing another modification example of the processing means 3. As shown in FIG. 6, the processing means 3 includes a processing unit 36, and the processing unit 36 is received in the unit receiving section of the paper sheet processing apparatus 1. As shown on the left side of FIG. 6, the processing unit 36 is equipped with a perforation forming blade 361 on the lower side and a crease forming blade 362 on the upper side and is further equipped, between the perforation forming blade 361 and the crease forming blade 362, with a receiving member 363 opposed to the respective blades 361 and 362. Furthermore, the processing unit 36 is rotatable in the vertical direction around the axis 363*a* positioned at the center of the receiving member 363 inside the unit receiving section. Moreover, as shown on the left side of FIG. 6, in the case that the processing unit 36 forms a crease in a paper sheet, the processing unit 36 rotates around the axis 363*a* so that the crease forming blade 362 is positioned on the upper side, and the crease forming blade 362 positioned on the upper side forms a crease in the paper sheet. What's more, as shown on the right side of FIG. 6, in the case that the processing unit 36 forms a perforation in a paper sheet, the processing unit 36 rotates around the axis 363*a* so that the perforation forming blade 361 is positioned on the upper side, and the perforation forming blade 361 positioned on the upper side forms a perforation in the paper sheet.

MODIFICATION EXAMPLE 3 OF THE PROCESSING MEANS

Figure 7:
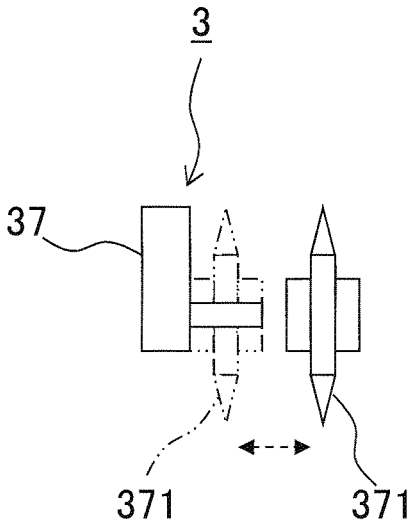
FIG. 7 is a schematic cross-sectional view showing still another modification example of the processing means.

FIG. 7 is a schematic cross-sectional view showing still another modification example of the processing means 3. As shown in FIG. 7, the processing means 3 includes a processing unit 37, and the processing unit 37 is received in the unit receiving section of the paper sheet processing apparatus 1. The processing unit 37 is detachably equipped with a processing blade, and in the case that the processing unit 37 forms a perforation in a paper sheet, a perforation forming blade 371 is mounted on the processing unit 37. Furthermore, in the case that the processing unit 37 forms a crease, a crease forming blade is mounted on the processing unit 37. As described above, an appropriate processing blade is mounted on the processing unit 37 depending on the process to be performed by the processing unit 37. Furthermore, in the case that the processing unit 37 is detachably equipped with such a processing blade, the kind of the blade to be mounted on the processing unit is displayed in addition to the name of the processing unit as processing means setting information, and this display is particularly effective.

MODIFICATION EXAMPLE 4 OF THE PROCESSING MEANS

Figure 8:
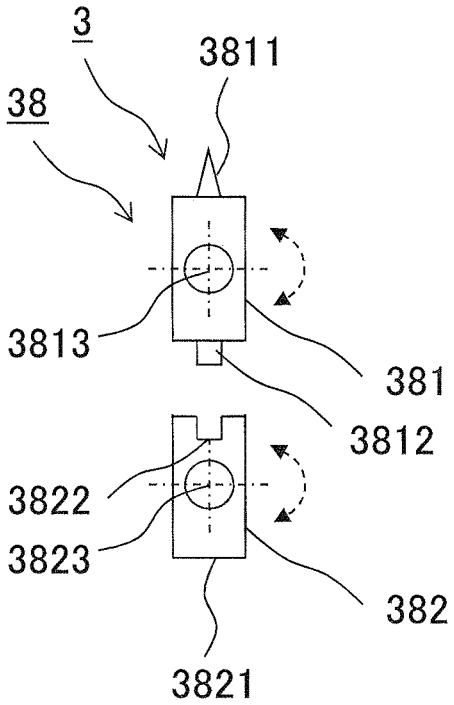
FIG. 8 is a schematic cross-sectional view showing yet still another modification example of the processing means.

FIG. 8 is a schematic cross-sectional view showing yet still another modification example of the processing means 3. As shown in FIG. 8, the processing means 3 includes a processing unit 38, and the processing unit 38 is received in the unit receiving section of the paper sheet processing apparatus 1. The processing unit 38 is equipped with an upper blade section 381 and a lower blade section 382; the upper blade section 381 is equipped with a perforation forming blade 3811 and a crease forming blade 3812, and the lower blade section 382 is equipped with a perforation forming blade receiving section 3821 and a crease forming blade receiving section 3822. The upper blade section 381 is rotatable around an axis 3813 in the vertical direction, and the lower blade section 382 is rotatable around an axis 3823 in the vertical direction. In the case that the processing unit 38 forms a crease in a paper sheet, the upper blade section 381 rotates around the axis 3813 so that the crease forming blade 3812 is positioned on the lower side, the lower blade section 382 rotates around the axis 3823 so that the crease forming blade receiving section 3822 is positioned on the upper side, and a crease is formed in the paper sheet by the crease forming blade 3812 and the crease forming blade receiving section 3822. Furthermore, in the case that the processing unit 38 forms a perforation in a paper sheet, the upper blade section 381 rotates around the axis 3813 so that the perforation forming blade 3811 is positioned on the lower side, the lower blade section 382 rotates around the axis 3823 so that the perforation forming blade receiving section 3821 is positioned on the upper side, and a perforation is formed in the paper sheet by the perforation forming blade 3811 and the perforation forming blade receiving section 3821.

MODIFICATION EXAMPLE 5 OF THE PROCESSING MEANS

Figure 9:
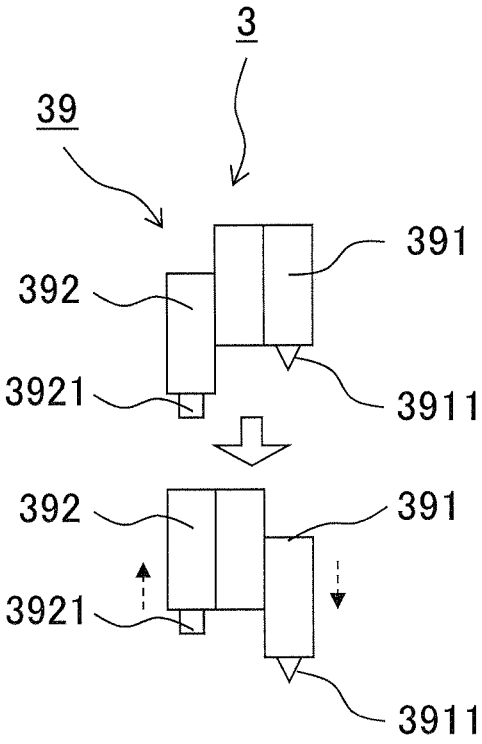
FIG. 9 is a schematic cross-sectional view showing a further modification example of the processing means.

FIG. 9 is a schematic cross-sectional view showing a further modification example of the processing means 3. As shown in FIG. 9, the processing means 3 includes a processing unit 39, and the processing unit 39 is received in the unit receiving section of the paper sheet processing apparatus 1. The processing unit 39 is equipped with a perforation forming section 391 and a crease forming section 392; the perforation forming section 391 is equipped with a perforation forming blade 3911 on the lower portion thereof, and the crease forming section 392 is equipped with a crease forming blade 3921 on the lower portion thereof. The perforation forming section 391 and the crease forming section 392 are respectively movable in the vertical direction. Furthermore, as shown on the upper side of FIG. 9, in the case that the processing unit 39 forms a crease in a paper sheet, the crease forming section 392 moves downward, and the crease forming blade 3921 of the crease forming section 392 forms a crease in the paper sheet. Moreover, as shown on the lower side of FIG. 9, in the case that the processing unit 39 forms a perforation in a paper sheet, the perforation forming section 391 moves downward, and the perforation forming blade 3911 of the perforation forming section 391 forms a perforation in the paper sheet.

Although the cases in which the processing units form creases or perforations have been described as examples in the modification examples of the processing means shown in FIGS. 5 to 9, the contents of the processes are not limited to crease forming or perforation forming, but include cutting, half-cutting, etc.

The present invention is not limited to the configurations described in the above-mentioned embodiment, but can include a variety of modification examples devisable by those skilled in the art without departing from the contents described in the appended claims.

INDUSTRIAL APPLICABILITY

The present invention can provide a paper sheet processing apparatus configured so as to display processing means setting information in consideration of the contents of processing and the order of processing on the basis of the processing condition for paper sheets, whereby the apparatus is highly useful in industries.

REFERENCE SIGNS LIST

1 paper sheet processing apparatus
2 conveying means
3 processing means
5 control section
6 input section
7 display section
8 storage section
9 waste box
10 apparatus body
11 paper sheet feeding section
12 paper sheet discharging section
20 conveying route
21 rollers
31 perforation forming unit
32 crease forming unit
33 slitter unit
34 cutter unit
35 processing unit
36 processing unit
37 processing unit
38 processing unit
39 processing unit
41 unit receiving section
42 unit receiving section
43 unit receiving section
44 unit receiving section

The invention claimed is:

1. A paper sheet processing apparatus for performing processes on paper sheets while conveying the paper sheets, comprising:

an apparatus body, processing means for performing predetermined processes on the paper sheets, a control section for controlling an operation of the paper sheet processing apparatus, an input section to which a paper sheet processing condition is input, a display section for displaying an operation information of the paper sheet processing apparatus, wherein the processing means is configured so that a processing pattern for the paper sheets can be changed, the processing means including plural kinds of processing units that are different in the kinds of processes the processing units are configured to perform, the control section obtains processing means setting information derived from user-owned information, the user-owned information being indicative of the plural kinds of processing units, which are owned by a user, the processing means setting information serving as the processing pattern of the processing means for achieving the processing condition having been input to the input section, and the control section displays the processing means setting information on the display section.

2. The paper sheet processing apparatus according to claim 1, further comprising a storage section for storing user-owned information serving as the processing pattern of the processing means owned by the user and included in the processing means, wherein, the control section obtains processing means setting information preferentially including the processing pattern included in the user-owned information and displays the processing means setting information on the display section.

3. The paper sheet processing apparatus according to claim 1, wherein the paper sheet processing apparatus is further equipped with one or more unit receiving sections, provided in the apparatus body, for detachably receiving the respective processing units, the paper sheet processing apparatus is equipped, as the processing units, with a cutting unit for cutting a paper sheet and at least one processing unit selected from among a perforation forming unit for forming a perforation in a paper sheet, a crease forming unit for forming a crease in a paper sheet, a cutting unit for cutting a paper sheet and a conveying unit for assisting the conveyance of a paper sheet, and in the case that paper sheet cutting is included in the processing condition having been input to the input section, the control section obtains, as processing means setting information, processing unit receiving information indicating the kinds of processes of the processing units to be received in the respective unit receiving sections so that the cutting unit is placed on the downstream side of the paper sheet processing from the other processing units, and the control section displays the processing unit receiving information on the display section.

4. The paper sheet processing apparatus according to claim 3, wherein the processing unit receiving information includes the information on the processing blades provided in the processing units.

5. The paper sheet processing apparatus according to claim 1, wherein the user-owned information identifies the plural kinds of processing units, which are owned by the user.

6. A paper sheet processing apparatus for performing processes on paper sheets while conveying the paper sheets, comprising:

an apparatus body, processing means for performing predetermined processes on the paper sheets, a control section for controlling an operation of the paper sheet processing apparatus, an input section to which a paper sheet processing condition is input, and a display section for displaying an operation information of the paper sheet processing apparatus, wherein the processing means is configured so that a processing pattern for the paper sheets can be changed, the processing means including plural kinds of processing units that are different in the kinds of processes the processing units are configured to perform, wherein the control section obtains processing means setting information, serving as the processing pattern of the processing means for achieving the processing condition having been input to the input section, and displays the processing means setting information on the display section, and wherein in a different setting state in which the processing means according to a processing pattern different from that indicated in the processing means setting information has been set, the control section judges whether the processing condition having been input to the input section can be achieved, and the control section performs control to carry out processing upon judging that the processing condition can be achieved and stops the processing upon judging that the processing condition cannot be achieved.

7. The paper sheet processing apparatus according to claim 6, wherein in the case that the control section judges that the processing condition having been input to the input section can be achieved in the different setting state and performs control to carry out processing, the control section adjusts paper sheet conveying speed so that a processing result similar to that based on the processing means setting information can be obtained.

8. The paper sheet processing apparatus according to claim 6, wherein the paper sheet processing apparatus is further equipped with one or more unit receiving sections, provided in the apparatus body, for detachably receiving the respective processing units, the paper sheet processing apparatus is equipped, as the processing units, with a cutting unit for cutting a paper sheet and at least one processing unit selected from among a perforation forming unit for forming a perforation in a paper sheet, a crease forming unit for forming a crease in a paper sheet, a cutting unit for cutting a paper sheet and a conveying unit for assisting the conveyance of a paper sheet, and in the case that paper sheet cutting is included in the processing condition having been input to the input section, the control section obtains, as processing means setting information, processing unit receiving information indicating the kinds of processes of the processing units to be received in the respective unit receiving sections so that the cutting unit is placed on the downstream side of the paper sheet processing from the other processing units, and the control section displays the processing unit receiving information on the display section.

9. A paper sheet processing apparatus for performing processes on paper sheets while conveying the paper sheets, comprising:

an apparatus body, processing means for performing predetermined processes on the paper sheets, a control section for controlling an operation of the paper sheet processing apparatus, an input section to which a paper sheet processing condition is input, a display section for displaying an operation information of the paper sheet processing apparatus, and a storage section for storing user-owned information serving as a processing pattern of the processing means owned by a user and included in the processing means, wherein the processing means is configured so that the processing pattern for the paper sheets can be changed, the processing means including plural kinds of processing units that are different in the kinds of processes the processing units are configured to perform, and the control section obtains the user-owned information from the storage section, the user-owned information being indicative of the plural kinds of processing units, which are owned by a user, and the control section performs control so that a processing condition under which processing cannot be performed according to the processing pattern of the processing means included in the user-owned information stored in the storage section cannot be input to the input section.

10. The paper sheet processing apparatus according to claim 9, wherein the control section displays, on the display section, the processing conditions under which processing can be performed according to the processing pattern of the processing means included in the user-owned information, and the input of the paper sheet processing condition to the input section is performed by selection from among the processing conditions displayed on the display section.

11. The paper sheet processing apparatus according to claim 9, wherein the user-owned information identifies the plural kinds of processing units, which are owned by the user.

* * * * *